US010029883B2

(12) United States Patent
Stolt et al.

(10) Patent No.: US 10,029,883 B2
(45) Date of Patent: Jul. 24, 2018

(54) METHOD FOR CONTROLLING AN ELEVATOR

(71) Applicant: KONE Corporation, Helsinki (FI)

(72) Inventors: Lauri Stolt, Helsinki (FI); Matti Räsänen, Hyvinkää (FI); Mika Alvesalo, Espoo (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 15/270,857

(22) Filed: Sep. 20, 2016

(65) Prior Publication Data

US 2017/0101289 A1 Apr. 13, 2017

(30) Foreign Application Priority Data

Oct. 8, 2015 (EP) ..... 15188901

(51) Int. Cl.
*B66B 1/32* (2006.01)
*B66B 1/30* (2006.01)

(52) U.S. Cl.
CPC ..... *B66B 1/32* (2013.01); *B66B 1/304* (2013.01)

(58) Field of Classification Search
CPC ..... B66B 1/32; B66B 1/304
USPC ..... 187/247
See application file for complete search history.

(56) References Cited

U.S. PATENT DOCUMENTS 4,600,865 A * 7/1986 Caputo ..... H02P 3/04 198/321
4,984,659 A * 1/1991 Nomura ..... H02P 3/04 187/288
5,076,399 A * 12/1991 Horbruegger ..... B66B 1/285 187/293
5,077,508 A * 12/1991 Wycoff ..... B66B 1/308 187/292

(Continued)

FOREIGN PATENT DOCUMENTS

GB 2 230 360 A 10/1990
WO WO 2011/113991 A1 9/2011

*Primary Examiner* — David Warren
(74) *Attorney, Agent, or Firm* — Birch, Stewart, Kolasch & Birch, LLP

(57) ABSTRACT

An elevator includes an elevator car and lifting machinery including a traction sheave, an electromechanical machinery brake, and an electric motor having a rotor. The traction sheave, the electromechanical machinery brake and the rotor of the electric motor are connected via a shaft, whereby the lifting machinery moves the elevator car upwards and downwards in a vertically extending elevator shaft controlled by a main control unit. The direction of rotation and the rotation speed of the rotor of the electric motor is detected with a sensor, the amplitude of the brake current provided to the machinery brake is measured, the amplitude of the brake current is increased until a first moment when the shaft and thereby also the rotor of the electric motor starts to rotate, which is detected by the sensor, the brake current is disconnected momentarily at the first moment, the torque acting on the shaft and the corresponding load in the elevator car at the first moment is determined based on the measured amplitude of the brake current at the first moment, whereby said torque is used in the main control unit for controlling the lifting machinery.

2 Claims, 4 Drawing Sheets

(56) References Cited

U.S. PATENT DOCUMENTS

| | | | | |
|---|---|---|---|---|
| 5,157,228 | A * | 10/1992 | Ackermann | B66B 1/34 187/247 |
| 9,731,935 | B2 * | 8/2017 | Stolt | B66B 1/304 |
| 2011/0108386 | A1 * | 5/2011 | Nurnberg | H02P 3/16 198/323 |
| 2012/0217098 | A1 * | 8/2012 | Putkinen | B66B 5/02 187/293 |
| 2012/0292136 | A1 * | 11/2012 | Washio | B66B 5/0031 187/393 |
| 2013/0153362 | A1 * | 6/2013 | Gonzalez Alemany | B66B 29/00 198/322 |
| 2014/0311257 | A1 * | 10/2014 | Hubbard | B66B 5/0037 73/862.12 |
| 2014/0374194 | A1 * | 12/2014 | Stolt | H02P 6/183 187/247 |
| 2016/0304314 | A1 * | 10/2016 | Xie | B66B 5/0037 |
| 2017/0008730 | A1 * | 1/2017 | Kattainen | H02P 23/0004 |

* cited by examiner

METHOD FOR CONTROLLING AN ELEVATOR

FIELD OF THE INVENTION

The invention relates to a method for controlling an elevator according to the preamble of claim 1.

BACKGROUND ART

An elevator comprises an elevator car, lifting machinery, ropes and a counter weight. The elevator car is supported on a sling surrounding the elevator car. The lifting machinery comprises a traction sheave, a machinery brake and an electric motor being connected via a shaft. The electric motor is used to rotate the traction sheave and the machinery brake is used to stop the rotation of the traction sheave. The lifting machinery is situated in a machine room. The lifting machinery moves the car upwards and downwards in a vertically extending elevator shaft. The elevator car is carried through the sling by the ropes, which connect the elevator car over the traction sheave to the counter weight. The sling is further supported with gliding means at guide rails extending in a vertically directed elevator shaft. The gliding means can comprise rolls rolling on the guide rails or gliding shoes gliding on the guide rails when the elevator car is mowing upwards and downwards in the elevator shaft. The guide rails are supported with fastening brackets at the side wall structures of the elevator shaft. The gliding means engaging with the guide rails keep the elevator car in position in the horizontal plane when the elevator car moves upwards and downwards in the elevator shaft. The counter weight is supported in a corresponding way on guide rails supported on the wall structure of the shaft. The elevator car transports people and/or goods between the landings in the building. The elevator shaft can be formed so that the wall structure is formed of solid walls or so that the wall structure is formed of an open steel structure.

The machinery brake is an electromechanical brake that stops the rotation of the traction sheave. The machinery brake comprises a brake disc connected to the shaft connecting the electric motor, the traction sheave and the machinery brake. The brake disc is positioned between a stationary frame and an armature plate. A spring acts against the armature plate, whereby the brake disc is pressed between the armature plate and the stationary frame flange. There are further coils acting on the armature plate in the opposite direction i.e. against the force of the spring. The brake is open when current is supplied to the coils. The magnetic force of the coil moves the armature plate against the force of the spring away from the surface of the brake disc. The spring will immediately press the brake disc between the armature plate and the stationary frame flange when the current supply to the coils is disconnected. Two coils are used for safety reason.

It is advantageous that the electric motor already produces the required torque in the right direction when the machinery brake is beginning to loosen the grip of the brake disc. This will eliminate twitches in the start of the movement of the elevator car when the elevator system is unbalanced. The people in the elevator car will experience a smooth start and a comfortable ride in this way. The direction and the amount of the torque that is required must thus be determined somehow in advance. This is done in prior art solutions by using the weight sensor of the elevator car. The weight sensor measures the load within the elevator car.

The problem in this prior art solution is that the measured values received from the weight sensor are not very precise and reliable.

There is thus a need for a more precise and more reliable method for controlling an elevator. More precise and reliable information of the direction and the amount of the torque needed in each situation, in order to be able to start the ride of the elevator car smoothly, is thus needed.

BRIEF DESCRIPTION OF THE INVENTION

An object of the present invention is to present a more precise and more reliable method for controlling an elevator.

The method according to the invention is characterized by what is stated in the characterizing portion of claim 1.

The elevator comprises an elevator car and a lifting machinery comprising a traction sheave, an electromechanical machinery brake, and an electric motor having a rotor, the traction sheave, the electromechanical machinery brake and the rotor of the electric motor being connected via a shaft, whereby the lifting machinery moves the elevator car upwards and downwards in a vertically extending elevator shaft controlled by a main control unit. The method comprises the steps of:

measuring the direction of rotation and the rotation speed of the rotor of the electric motor with a sensor, measuring the amplitude of the brake current provided to the machinery brake, increasing the amplitude of the brake current until a first moment when the shaft and thereby also the rotor of the electric motor starts to rotate, which is detected by the sensor, determining the torque acting on the shaft and the corresponding load in the elevator car at the first moment based on the measured amplitude of the brake current at the first moment, whereby said torque is used in the main control unit for controlling the lifting machinery.

The method is characterized by the further steps of:

disconnecting the brake current at the first moment when the shaft and thereby also the rotor of the electric motor starts to rotate.

The invention makes it possible to control the elevator in a more precise and more reliable way. The start of the ride of the elevator car can be made in a smooth way with the invention.

BRIEF DESCRIPTION OF THE DRAWINGS

The invention will in the following be described in greater detail by means of preferred embodiments with reference to the attached drawings, in which.

DETAILED DESCRIPTION OF EMBODIMENTS OF THE INVENTION

Figure 1:
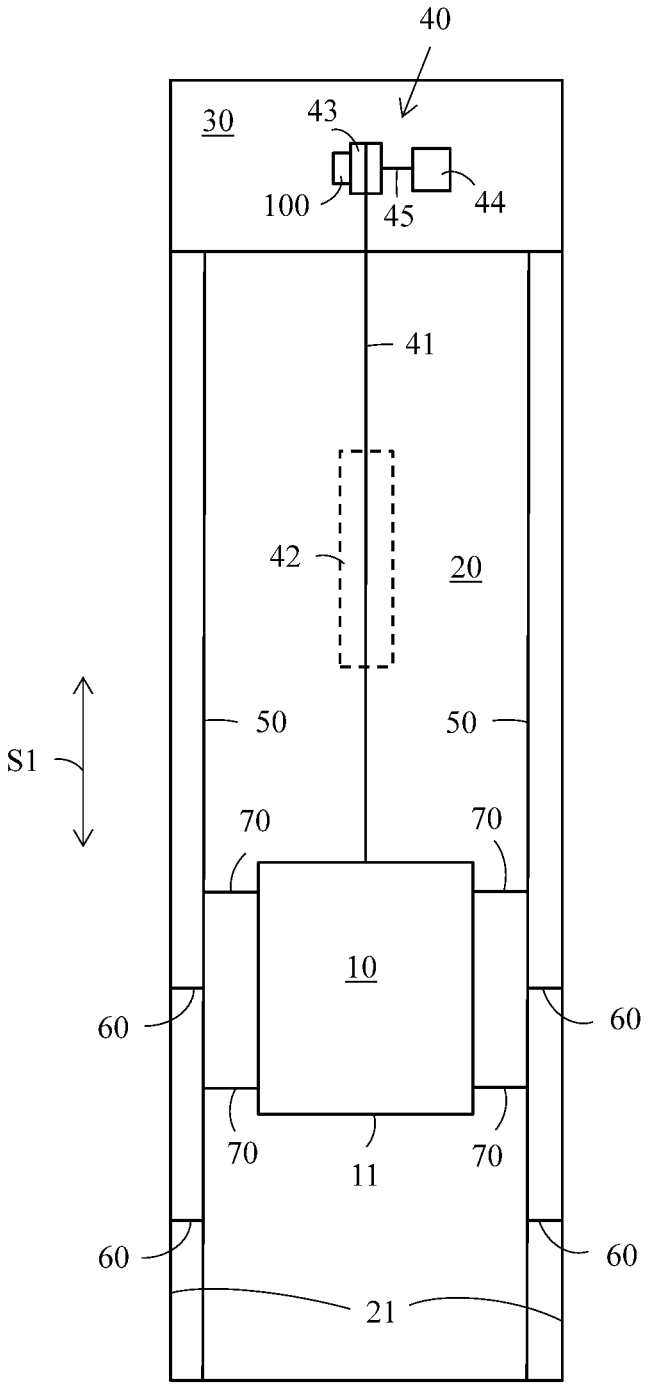
FIG. 1 shows a vertical cross section of an elevator.

FIG. 1 shows a vertical cross section of an elevator. The elevator comprises an elevator car 10, lifting machinery 40, ropes 41, and a counter weight 42. The elevator car 10 is supported on a sling 11 surrounding the elevator car 10. The lifting machinery 40 comprises a traction sheave 43, a machinery brake 100 and an electric motor 44 being connected via a shaft 45. The electric motor 44 is used to rotate the traction sheave 43 and the machinery brake 100 is used to stop the rotation of the traction sheave 43. The lifting machinery 40 is situated in a machine room 30. The lifting machinery 40 moves the car 10 upwards and downwards 51 in a vertically extending elevator shaft 20. The sling 11 and thereby also the elevator car 10 is carried by the ropes 41, which connect the elevator car 10 over the traction sheave 43 to the counter weight 42. The sling 11 of the elevator car 10 is further supported with gliding means 70 at guide rails 50 extending in the vertical direction in the elevator shaft 20. The figure shows two guide rails 50 at opposite sides of the elevator car 10. The gliding means 70 can comprise rolls rolling on the guide rails 50 or gliding shoes gliding on the guide rails 50 when the elevator car 10 is mowing upwards and downwards in the elevator shaft 20. The guide rails 50 are supported with fastening brackets 60 at the side wall structures 21 of the elevator shaft 20. The figure shows only two fastening brackets 60, but there are several fastening brackets 60 along the height of each guide rail 50. The gliding means 70 engaging with the guide rails 50 keep the elevator car 10 in position in the horizontal plane when the elevator car 10 moves upwards and downwards in the elevator shaft 20. The counter weight 42 is supported in a corresponding way on guide rails supported on the wall structure 21 of the elevator shaft 20. The elevator car 10 transports people and/or goods between the landings in the building. The elevator shaft 20 can be formed so that the wall structure 21 is formed of solid walls or so that the wall structure 21 is formed of an open steel structure.

The lifting machinery 40 can in an elevator, which is not provided with a separate machine room, be positioned in the elevator shaft 20, at the bottom of the elevator shaft 20 or at the top of the elevator shaft 20 or somewhere between the top and the bottom of the elevator shaft 20.

Figure 2:
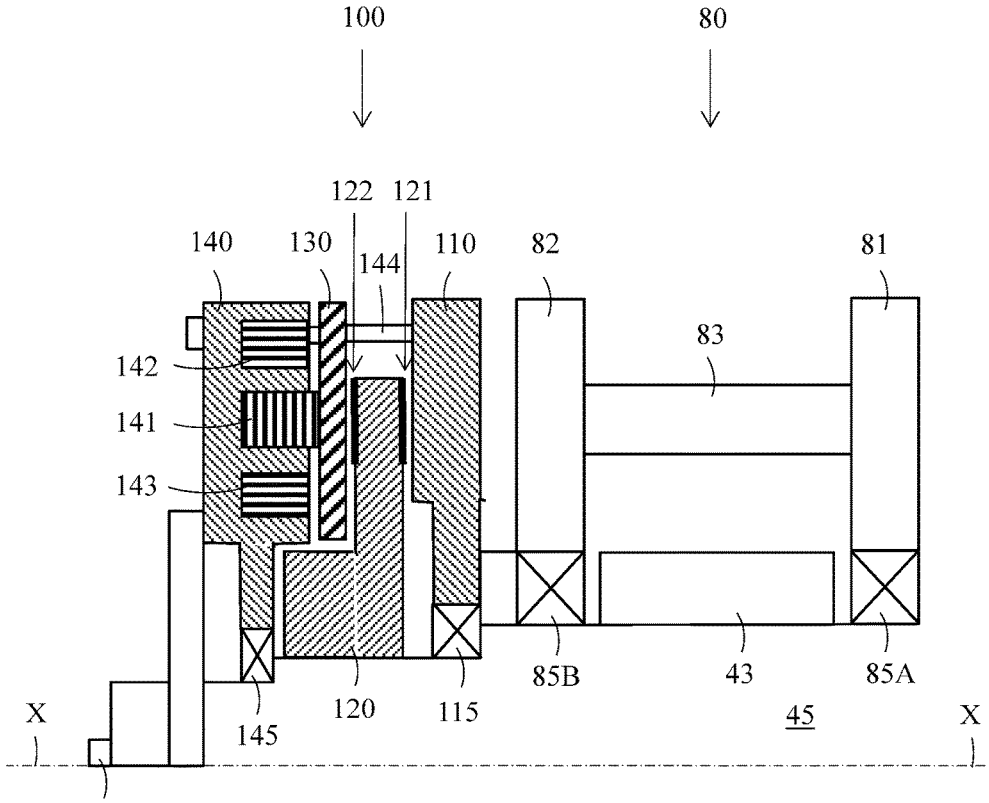
FIG. 2 shows a cross section of a traction sheave and a machinery brake for an elevator.

FIG. 2 shows a cross section of a traction sheave and a machinery brake for an elevator. The machinery brake 100 is an electromechanical brake that stops the rotation of the traction sheave 43 and thus also the rotation of the rotor of the electric motor 44. The figure shows only the upper part of the traction sheave 43 and the machinery brake 100 above the axial centre axis X-X of rotation. The construction is symmetrical in view of the axial centre axis X-X of rotation.

The traction sheave 43 is mounted within a stationary frame 80 comprising a first frame part 81 and a second frame part 82 at an axial X-X distance from the first frame part 81. The first frame part 81 and the second frame part 82 are connected by an intermediate frame part 83 extending in the axial X-X direction between the first frame part 81 and the second frame part 82. The first frame part 81 is supported on the shaft 45 with a first bearing 85A. The second frame part 82 is supported at the shaft 45 with a second bearing 85B. The traction sheave 43 is fixedly attached to the shaft 45 and rotates with the shaft 45. The traction sheave 43 is positioned axially between the first frame part 81 and the second frame part 82 and radially inside the intermediate frame part 83.

The machinery brake 100 comprises a stationary frame flange 110 supported on the shaft 45 with a third bearing 115 and a stationary magnet part 140 supported on the shaft 45 with a fourth bearing 145. The machinery brake 100 comprises further a brake disc 120 positioned between the frame flange 110 and the magnet part 140. The brake disc 120 is fixedly attached to the shaft 45 and rotates with the shaft 45. The machinery brake 100 comprises further a stationary armature plate 130 positioned between the brake disc 120 and the magnet part 140. The armature plate 130 is supported with axially X-X extending support bars 144 passing through holes in the armature plate 130. The armature plate 130 can move in the axial direction X-X but it is stationary in the rotational direction. There are two coils 142, 143 and a spring 141 within the magnet part 140. The spring 141 presses the armature plate 130 against the brake disc 120. The coils 142, 143 are activated by an electric current, which produces a magnetic force in the coils 142, 143. The magnetic force draws the armature plate 130 in the axial direction X-X against the force of the spring 141 to the magnet part 140 i.e. to the left in the figure. The brake disc 120 and thereby also the shaft 45 are free to rotate when electric current is conducted to the coils 142, 143. The spring 141 presses the armature plate 120 against the brake disc 120 when the electric current to the coils 142, 142 is disconnected. The pressure of the spring 141 causes the vertical opposite outer brake surfaces 121, 122 of the brake disc 120 to be pressed between the stationary armature plate 130 and the stationary frame flange 110. The friction between the first brake surfaces 121 of the brake disc 120 and the frame flange 110 and the friction between the second brake surface 122 and the armature plate 130 will stop the rotational movement of the brake disc 120 and thereby also the rotational movement of the shaft 45 and the traction sheave 43. The upwards or downwards S1 movement of the elevator car 10 in the elevator shaft 20 will thus be stopped.

Figure 3:
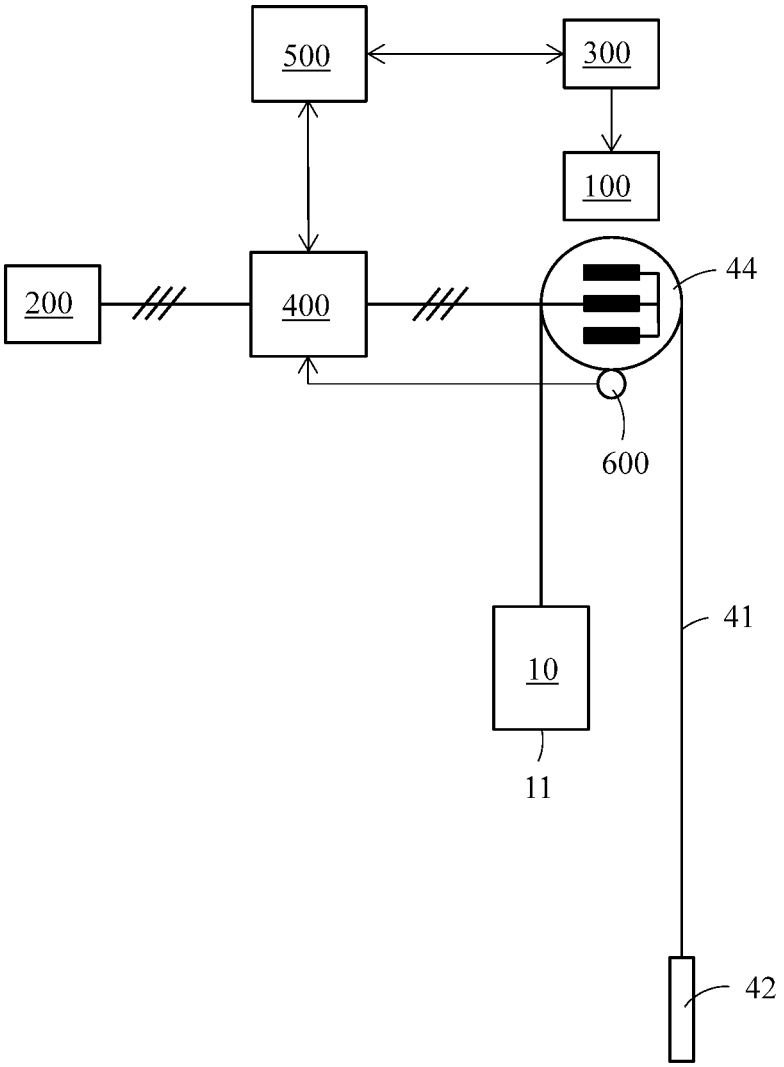
FIG. 3 shows a part of a control system for an elevator.

FIG. 3 shows a part of a control system for an elevator. The elevator car 10 is carried through the sling 11 by the ropes 41, which connect the elevator car 10 to the counter weight 42. The ropes 41 pass over the traction sheave 43 shown in FIG. 1. The traction sheave 43 is driven by the electric motor 44 via the shaft 45. The system comprises a machinery brake 100, a machinery brake control unit 300, a frequency converter 400, and a main control unit 500.

The frequency converter 400 is connected to the electrical grid 200. The electric motor 44 is advantageously a permanent magnet synchronous motor 44. The frequency converter 400 controls the rotation of the electric motor 44. The speed of rotation and the direction of rotation of the rotor of the electric motor 44 are measured with a sensor 600, which is connected to the frequency converter 400. The sensor 600 may be an encoder or a tachometer. Another possibility is to determine the movement of the rotor of the electric motor 44 from the position of the permanent magnets with a Hall-sensor or from a voltage or current measurement by calculating from the counter voltage of the electric motor 44. The frequency converter 400 also receives a rotational speed reference of the electric motor 44 from the main control unit 500. The rotational reference speed data of the electric motor 44 is the target value of the rotational speed of the electric motor 44.

The machinery brake control unit 300 is used to control the machinery brake 100 of the elevator. The machinery brake control unit 300 can e.g. be situated in connection with the control panel of the elevator or in connection with the main control unit 500 or in the vicinity of the machinery brake 100.

The principal of the control of the machinery brake 100 in accordance with the invention will be explained in the following.

The sensor 600 sends to the frequency converter 400 a measurement signal indicating when the rotor of the electric motor 44 starts to rotate and in which direction the rotor starts to rotate. Said measurement signal is transmitted by the frequency converter 400 to the main control unit 500. The main control unit 500 has prior to this instructed the machinery brake control unit 300 to gradually loosen the machinery brake 100. When the rotor of the electric motor 44 starts to rotate, the main control unit 500 records the amplitude of the brake current and instructs the machinery brake control unit 300 to close the machinery brake 100 i.e. to stop the rotation of the traction sheave 43. The main control unit 500 determines then based on the amplitude of the brake current the load of the elevator car 10 i.e. the torque that is needed to keep the elevator car 10 stationary. The main control unit 500 transmits then this determined torque as a control signal to the frequency converter 400. Then finally the main control unit 500 instructs the machinery brake control unit 300 to open the machinery brake 100 after which the main control unit 500 starts the ride of the elevator car 10.

If the determined load of the elevator car 10 exceeds the maximum load of the elevator car 10, then the main control unit 500 will not instruct the machinery brake control unit 300 to open the machinery brake 100. The elevator car 10 will remain stationary until the load of the elevator car 10 is reduced below the maximum load.

The main control unit 500 can receive the amplitude of the brake current directly from the machinery brake control unit 300. Another possibility is that the main control unit 500 determines the amplitude of the brake current based on the time that passed between the control signal to instruct the machinery brake control unit 300 to gradually loosen the machinery brake 100 was sent and the moment when the elevator car 10 moved.

The determining of the load of the elevator car 10 may be made by calculating or the load can be retrieved from a table where the correlation between the brake current and the corresponding elevator car load has been defined beforehand and saved to the memory of the main control unit 500.

The height position of the elevator car 10 in the elevator shaft 20 is naturally also needed when the load of the elevator car 10 is determined from the torque that is needed to keep the elevator car 10 stationary. The position of the elevator car 10 determines the balance between the elevator car 10, the roping 41 and the counter weight 42. Updated information of the height position information of the elevator car 10 is constantly received by the main control unit 500 in all elevator applications.

Figure 4:
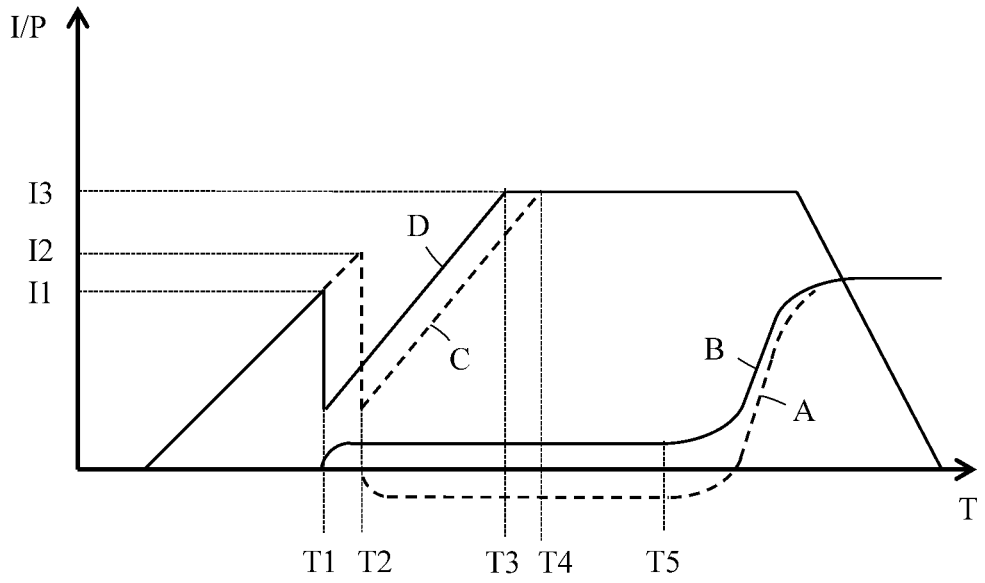
FIG. 4 shows the principle of the invention.

FIG. 4 shows the principal of the invention.

The vertical axis in the figure represents the brake current I and the elevator car position P and the horizontal axis represents the time T. The curve A represents the elevator car position P and curve C represents the corresponding brake current I at 25% elevator car load. The curve B represents the elevator car position P and the curve D represents the corresponding brake current I at 100% elevator car load. The assumption here is that the weight of the counterweight equals the sum of the weight of the empty elevator car and 50% of the weight of the maximum load within the elevator car. The curve D represents thus a situation where the unbalance in the elevator system is 50% and the curve C represents a situation where the unbalance in the elevator system is 25%.

The curve D shows that the brake current I is increased from null until a value I1. This brake current value I1 is achieved at a first moment T1. This first moment T1 is the moment when the shaft 43 starts to rotate i.e. the brake 100 loosens the grip at 100% elevator load. The brake current I is at the first moment T1 immediately disconnected when the shaft 43 starts to rotate, which is seen in curve D. The measured brake current I1 at the first moment T1 is used to determine the torque acting on the shaft 43 at the first moment T1. The electric motor 44 is then set to produce the determined torque in a direction opposite to the direction into which the shaft 43 started to rotate at the first moment T1, which is seen in curve A. The brake current I is then again increased until a maximum brake current value I3 is achieved. This maximum brake current value I3 is achieved at a third moment T3 when the brake 100 is completely open. The electric motor 44 produces all the time the set torque, which means that the elevator car 10 is kept in place in the shaft 20. The torque of the electric motor 44 is then later at a fifth moment T5 increased so that the elevator car 10 starts to move in the elevator shaft 20, which is seen in the rising part of curve B.

The curve C shows that the brake current I is increased from null until a value I2. This brake current I2 is achieved at a second moment T2. This second moment T2 is the moment at which shaft 43 starts to rotate i.e. the brake loosens the grip at 25% elevator load. The brake current I is at the second moment T2 immediately disconnected when the shaft 43 starts to rotate, which is seen in curve C. The measured brake current I at the second moment T2 is used to determine the torque acting on the shaft 43 at the second moment T2. The electric motor 44 is then set to produce the determined torque in a direction opposite to the direction into which the shaft 43 started to rotate at the second moment T2, which is seen in curve A. The brake current I is then again increased until a maximum brake current I3 is achieved. This maximum brake current I3 is achieved at a fourth moment T4 when the brake 100 is completely open. The electric motor 44 produces all the time the set torque, which means that the elevator car 10 is kept in place in the shaft 20. The torque of the electric motor 44 is then later at a fifth moment T5 increased so that the elevator car 10 starts to move in the elevator shaft 20, which is seen in the rising part of curve A.

The elevator car 10 will in both cases start to move smoothly in the desired direction upwards or downwards S1 in the shaft 20 without any twitch.

The idea of the invention is to raise the amplitude of the brake current I to the coils 142, 143 in the machinery brake 100 in a ramp like manner. The angular position of the rotor of the electric drive motor 44 is monitored with the sensor 600. Immediately at the moment when the rotor and thereby also the shaft 44 connected to the rotor starts to rotate, the torque acting on the shaft 45 can be determined in the following manner:

1. The direction of the torque acting on the shaft is determined based on the direction into which the shaft starts to rotate at the moment when the machinery brake begins to open.

2. The magnetic force acting on the machinery brake and thereby the torque acting on the machinery brake at the moment when the shaft starts to rotate is determined based on the amplitude of the brake current at the moment when the shaft starts to rotate.

The magnetic force acting on the brake 100 is proportional to the brake current I and can therefore be determined based on the brake current I. The torque acting on the shaft 45 can be determined based on the magnetic force acting on the brake 100 and the radius of the brake disc 120 at the point of the brake surfaces 121, 122.

The torque produced by the machinery brake 100 is proportional to the unbalance in the elevator system i.e. the unbalance between the weight of the counterweight 42 and the sum of the weights of the empty elevator car 10 and the load within the elevator car 10. The greater the unbalance is the more torque is needed to move the elevator car 10. The counterweight 42 is normally dimensioned so that it equals to the sum of the weight of the empty elevator car 10 and half of the maximum weight of the load within the elevator car 10. The elevator system is thus in balance when the elevator car 10 is loaded with half of the maximum load. The elevator system is in unbalance when the load in the elevator car 10 is more or less than half of the maximum load.

The magnetic force produced by the electromechanical brake 100 can be calculated based on the brake current I, the number of windings of the coils 142, 143, and the dimensions of the magnetic part 140. The torque acting on the shaft 45 can be calculated based on the magnetic force produced by the electromechanical brake 100 and the radius of the brake disc 120 at the point of the brake surfaces 121, 122.

Another possibility is to determine the relation between the brake current I and the torque needed based on tests in which predetermined loads are put into the elevator car 10 so that the unbalance of the elevator system is known e.g. 0%, 12.5%, 25%, 37.5% and 50%. The brake current I is then measured for each different load at the moment when the shaft 45 starts to rotate. The torque needed for each different load can be determined based on the unbalance of the elevator system and the dimensions of the traction sheave. The determined relation between the brake current I and the torque can then be used to set the torque for the electric motor 44 based on the measured brake current I at the moment when the shaft 45 starts to rotate.

The use of the invention is naturally not limited to the type of elevator disclosed in FIG. 1, but the invention can be used in any type of elevator e.g. also in elevators lacking a machine room and/or a counterweight.

The use of the invention is also not limited to the type of machinery brake disclosed in FIG. 2, but can be used with any type of electromechanical machinery brake.

It will be obvious to a person skilled in the art that, as the technology advances, the inventive concept can be implemented in various ways. The invention and its embodiments are not limited to the examples described above but may vary within the scope of the claims.

The invention claimed is:

1. A method for controlling an elevator, the elevator comprising an elevator car and lifting machinery comprising a traction sheave, an electromechanical machinery brake, and an electric motor having a rotor, the traction sheave, the electromechanical machinery brake and the rotor of the electric motor being connected via a shaft, whereby the lifting machinery moves the elevator car upwards and downwards in a vertically extending elevator shaft controlled by a main control unit, the method comprising the steps of:

measuring a direction of rotation and a rotation speed of the rotor of the electric motor with a sensor before and after a rotation of the electric motor occurs;

measuring an amplitude of a brake current provided to the machinery brake;

the main control unit instructing a brake controller to gradually loosen the machinery brake so as to increase the amplitude of the brake current until a first moment when the shaft and the rotor of the electric motor starts to rotate, the first moment being detected by the sensor by measuring the direction of rotation and the rotation speed of the rotor, and being transmitted to the main control unit;

determining a torque acting on the shaft and the corresponding load in the elevator car at the first moment based on the measured amplitude of the brake current at the first moment, whereby said torque is used in the main control unit for controlling the lifting machinery; and disconnecting the brake current at the first moment when the shaft and the rotor of the electric motor starts to rotate.

2. The method for controlling an elevator according to claim 1, further comprising the steps of:

setting the electric motor to produce the determined torque in a direction opposite to the measured direction of rotation of the shaft at the first moment; and increasing the amplitude of the brake current again until the machinery brake is totally open, whereby the elevator car remains stationary until the lifting machinery is set to change the torque acting on the shaft in order to start movement of the elevator car in a desired direction upwards or downwards in the elevator shaft.

* * * * *